United States Patent [19]

Aubert

[11] Patent Number: 4,808,956

[45] Date of Patent: Feb. 28, 1989

[54] CORELESS SOLENOIDAL MAGNET

[75] Inventor: Guy Aubert, Grenoble, France

[73] Assignee: Thomson-CGR, Paris, France

[21] Appl. No.: 905,319

[22] PCT Filed: Nov. 29, 1985

[86] PCT No.: PCT/FR85/00340

§ 371 Date: Aug. 13, 1986

§ 102(e) Date: Aug. 13, 1986

[87] PCT Pub. No.: WO86/03881

PCT Pub. Date: Jul. 3, 1986

[30] Foreign Application Priority Data

Dec. 14, 1984 [FR] France ..... 85 19193

[51] Int. Cl.[4] ..... H01F 5/00

[52] U.S. Cl. ..... 335/299

[58] Field of Search ..... 335/299; 324/318, 319, 324/320, 321

[56] References Cited

U.S. PATENT DOCUMENTS

| | | | |
|---|---|---|---|
| 3,281,737 | 10/1966 | Swartz | 335/299 X |
| 4,500,860 | 2/1985 | Vermilyea | 335/216 |
| 4,506,224 | 3/1985 | Krause | 324/319 |
| 4,517,516 | 5/1985 | Hill et al. | 324/318 |
| 4,591,818 | 5/1986 | Butson | 335/299 |
| 4,602,234 | 7/1986 | Butson | 335/299 |
| 4,686,473 | 8/1987 | Chesneau et al. | 324/320 |
| 4,694,255 | 9/1987 | Hayes | 324/318 |

*Primary Examiner*—George Harris

*Attorney, Agent, or Firm*—Oblon, Fisher, Spivak, McClelland & Maier

[57] ABSTRACT

A coreless solenoidal magnet is provided formed by a Bitter coil with improved field homogeneity. According to the invention the tie rods of the stack of disks are used for bringing the current back towards one of the axial ends of the magnet without creating a parasite field.

8 Claims, 4 Drawing Sheets

CORELESS SOLENOIDAL MAGNET

BACKGROUND OF THE INVENTION

The invention relates to a solenoidal magnet, without a core, having one or more coils, whose technological structure is derived from that of a conventional Bitter coil; the invention relates more particularly to improvements for improving the homogeneity of the magnetic field generated by such a type of magnet.

Bitter coils are well known for producing intense magnetic fields. In theory, the structure proposed by Bitter is a winding formed of metal annular disks split so as to form as many turns and connected together so as to define a substantially helical winding with flat turns. The stack of disks is held in position by a plurality of tie rods. This structure is advantageous for it allows efficient cooling of the magnet by forming holes in the rings (and in the insulators separating these disks), these holes being disposed in the same configuration from one disk to another so as to form an assembly of channels parallel to the axis of the coil, in which a cooling fluid flows, for example deionized water, kerosene or oil.

The invention proposes perfecting such a type of magnet so that the magnetic field generated in a sphere of interest of prescribed radius, whose center merges with the center of symmetry of this magnet, has very good homogeneity. A privileged field of application of the invention is in fact that of image formation by nuclear magnetic resonance (NMR) where it is necessary to have a relatively high magnetic field (0.15 to 1.5 teslas with a very high homogeneity, of the order of 1 to 10 parts per million (ppm). With a sufficiently long Bitter coil, a certain homogeneity may be obtained about the center of symmetry of this coil. This homogeneity will be more easily attained and with a more compact structure either by varying the thickness of the disks along the axis of the coils or by aligning several Bitter coils along a common axis, the lengths of the coils and spacing therebetween being chosen so as to obtain the required homogeneity.

These solutions are described in other patent applications filed by the applicant. The improvements of the invention apply not only to the magnet with a single coil but also to a magnet with several aligned coils.

There may in fact exist other structural causes of inhomogeneity of the magnetic field generator or causes for the disturbance of this magnetic field.

Among these the way in which the current is applied to the magnet must be taken particularly into consideration. In fact, if the connection between the supply source and the magnet is formed conventionally by means of two conductors connected respectively to the axial ends of the magnet, field disturbances generated by these conductors may degrade the homogeneity of the field in the sphere of interest.

The purpose of the invention is first of all to overcome this problem.

SUMMARY OF THE INVENTION

To this end, the invention relates to a coiled magnet having at least one Bitter type coil, including essentially a substantially helical winding formed by a stack, with interpositioning of insulators, of annular disks each having a cut so as to form a turn, said turns being connected to each other. Which magnet further includes one or more conductors returning the current to one of the axial ends of the magnet, formed and/or disposed so as to distribute the flow of the current longitudinally over a cylindrical surface coaxial to said coil.

This way of "bringing the current back" parallel to the axis of the magnet and thereabouts creates no field disturbance in the internal space of the magnet.

Furthermore, through the above defined arrangement, the current lead-ins are situated at the same axial end of the magnet. The power supply wires may then be easily arranged in parallel relation in pairs so as to avoid creating any disturbance, cables with coaxial structure are preferably used. The above mentioned concept may be given concrete form by a single tubular conductor surrounding the coil and connected to one of the axial ends thereof for bringing the current back. This arrangement has the further advantage of forming a sort of Faraday cage which, in the case of application to NMR image formation, protects the radio frequency antennae from external disturbances. An approximation of this tubular conductor may be formed by returning the current through several longitudinal rods spaced evenly apart over said cylindrical surface, these rods being connected in parallel together and in series as a whole with said coil so as to have flowing therethrough substantially equal fractions of the total current passing through said coil. In the second possible embodiment, these rods are preferably tie rods (or some of them) whose first function is to hold the stack of disks of the Bitter coil in position.

Furthermore, in one embodiment of the Bitter magnet at present widely used, the connection of two adjacent turns is simply attained by forming each insulating disk, inserted between the two conducting rings, so that it has a cut out in the form of a sector and by clamping the stack of conducting disks and insulating disks between two end plates, by means of the above mentioned tie rods. The electrical contacts between two adjacent turns is thus established through the corresponding cut out under the effect of a clamping, the construction of the magnet being thus greatly facilitated. However, the fact of considering the problem of obtaining a very uniform field from Bitter coil(s) leads to recognizing in this arrangement another cause of disturbance of the magnetic field. In fact, the current density variation at each turn in the contact sector is another cause of inhomogeneity. With this in mind, the invention also relates to a magnet in accordance with the preceding definition, in which each spire end has a groove and tongue joint and two adjacent turns are connected end to end by welding such joints of complementary shapes.

BRIEF DESCRIPTION OF THE DRAWINGS

The invention will be better understood and other advantages will appear better from the following description, given solely by way of example, with reference to the accompanying drawings in which.

DESCRIPTION OF THE PREFERRED EMBODIMENT

Figure 1:
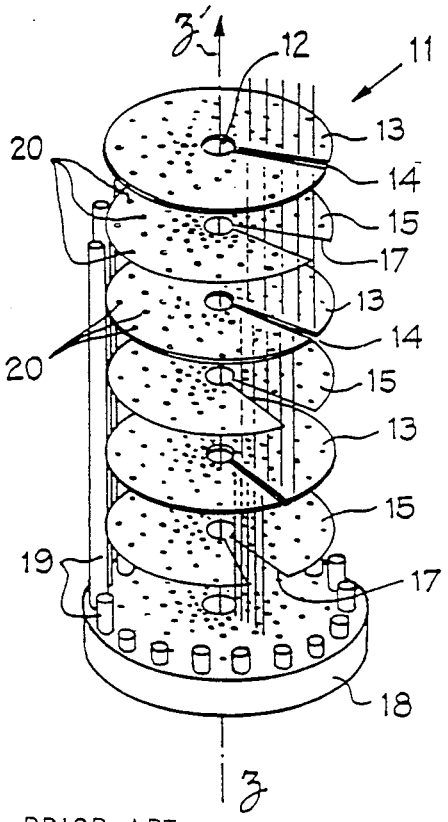
PRIOR ART Fig. 1
FIG. 1 is a perspective view of a conventional Bitter coil.

FIG. 1 shows schematically an exploded perspective view of a conventional Bitter magnet 11 essentially used for producing an intense magnetic field inside the central hole 12 defined by a stack of annular conducting disks 13 (typically made from copper or aluminum) each having a cut 14, here a radial slit, transforming each disk 13 into a turn. The magnetic field generated is oriented along the axis ZZ'. Thin insulating disks 15 similar to disks 13 are inserted therebetween for insulating the turns. Instead of a fine cut, they each have a large cut out 17 in the form of a sector, for connecting the turns by simple clamping of the stack between two end plates such as 18, by means of a plurality of tie rods 19 spaced evenly apart over a cylindrical surface parallel to axis ZZ'. The conducting disks 13 and the isolating disks 15 are pierced with holes 20 formed in the same configuration from one disk to another, so as to define a plurality of channels parallel to axis ZZ', in which a cooling fluid flows. The concentration of holes 20 is greater towards the center of the disk 4, in a Bitter coil, the current density at a point of a flat turn is inversely proportional to the distance of the point considered from axis ZZ'. Heating is therefore greater within the heart of the mass of conductors, whence the need to increase the number of cooling fluid channels in the vicinity of hole 12.

Figure 2:
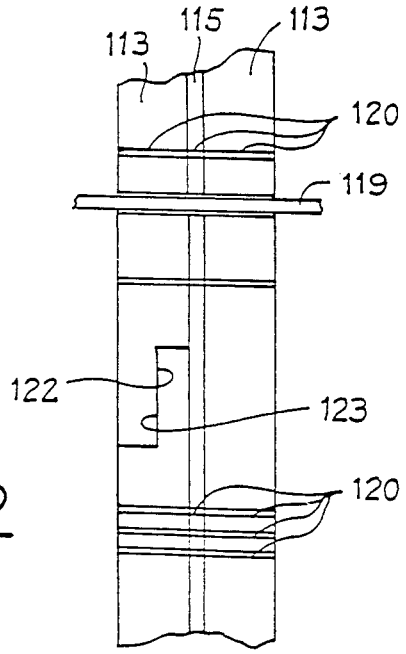
FIG. 2 is a detail view of two adjacent turns illustrating one of the modifications of the Bitter coil.
Figure 3:
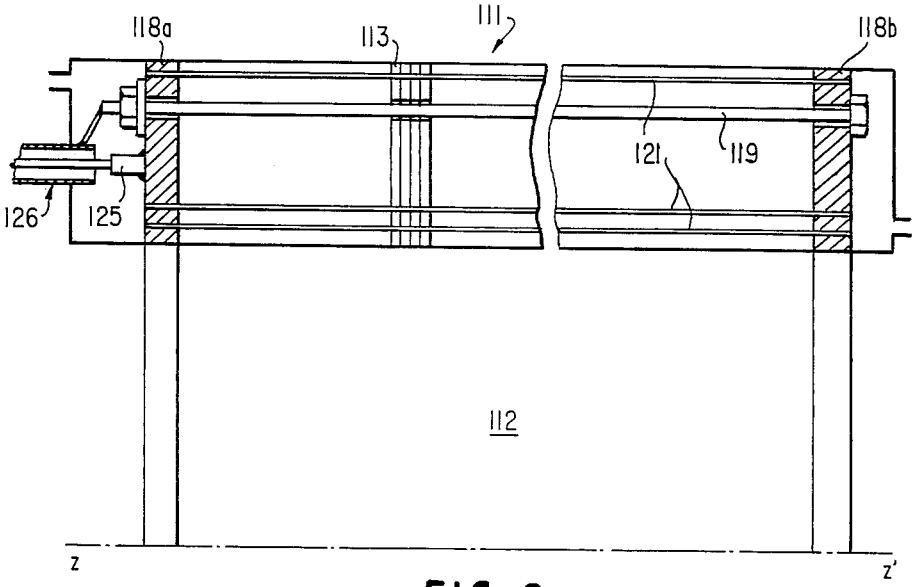
FIG. 3 is a schematical view in longitudinal half section of a magnet in accordance with the invention.
Figure 4:
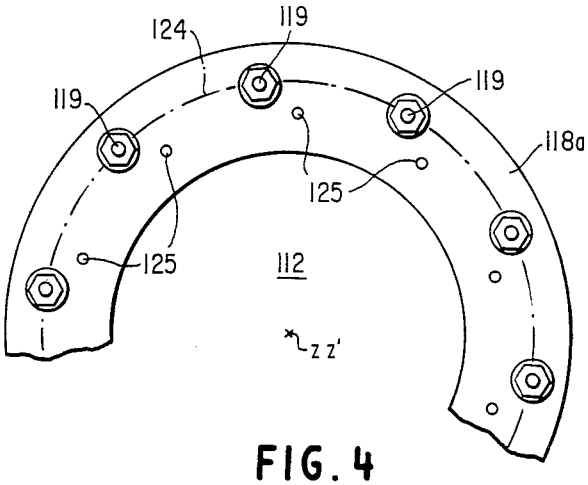
FIG. 4 is a partial view of the magnet of FIG. 3 through the section IV—IV thereof.

The magnet shown in FIGS. 2 to 4 is derived from the conventional structure described with reference to FIG. 1. Similar structural elements bear the same numerical references increased by 100. The Bitter coil 11 has then a central hole 112, conducting disks 113 and isolating disks 115. Disks 113 and 115 have the same configuration of holes 120 and the stack of disks 113 and 115 is clamped by tie rods 119 between two annular end plates **118*a*, 118*b*. The holes 120 formed in disks 113 and 115 are in concordance so as to define a plurality of longitudinal channels 121, parallel to the axis ZZ'. In the example of FIG. 3**, the general proportions of the coil have been adapted for an application to NMR image formation. The external diameter and especially the internal diameter of the disks are increased so as to free a sufficient volume for receiving a recumbent human being.

According to one of the modifications of the above described conventional structure, the adjacent turns are no longer connected by contact of the faces of the disks in the vicinity of the cuts but by welding the turn ends. The ends of each turn thus have tongue and groove joints of complementary shapes 122, 123 and two adjacent turns (see FIG. 2) are connected end to end by welding two tongue and groove joints of complementary shapes. In FIG. 2, an insulating disk 115 is shown between the two adjacent turns connected end to end. In practice, the insulating disk is for example cut out from a thin dielectric film but it may be omitted if the conducting disks are made from aluminum and if the insulator is formed by anodization of these two disks. In the case of using insulating disks cut out from a dielectric material, they are cut radially and are connected end to end as the turns are welded.

Moreover, according to an important characteristic of the invention, the magnet includes one or more conductors for returning the current to one of the axial ends of the magnet, formed and/or disposed so as to distribute the flow of said current longitudinally over a cylindrical surface coaxial with the coil or coils forming the magnet. The configuration which in theory answers best to this definition is a cylindrical tubular casing, external to the coil and coaxial therewith and connected by one of its axial ends to one of the end plates, for example plate **118*b*. It can be demonstrated that the current flow in this tubular casing creates no disturbing magnetic field in the central hole 112. The above mentioned coaxial cylindrical surface is in this case that of the tubular casing itself. However, this tubular casing may be replaced by a sufficient number of longitudinal rods, spaced evenly apart over a fictitious cylindrical surface 124, these rods being connected together so as to define a sort of squirrel cage and this cage is connected in series, as a whole, with said coil. Thus, these rods have flowing therethrough substantially equal fractions of the total current which passes over the coil or coils. In the embodiments shown in FIGS. 2 to 4, the tie rods 119 are used as current return rods. These tie rods are insulated from the conducting disks 113 and it is sufficient for the tie rods to be connected to the end plate 118*b* if coil 111 is the only one or to the corresponding plate of the coil nearest the axial end of the magnet to which no current lead-in cable is connected. In this case, plate 118distributes the current between the two tie rods. On the other hand, if we consider the first axial end mentioned to which the current lead-in cables are connected, (that is to say the end formed by the end plate 118*a* if coil 111 is the only one or if it is the nearest coil to said end) the tie rods 119 pass through plate 118*a* and are insulated therefrom whereas this plate 118*a* includes as many connecting terminals 125 as there are tie rods, disposed respectively in the vicinity of each of them so as to allow the magnet to be supplied with electricity from an assembly of pairs of conducting wires. In each pair, the conducting wires are arranged parallel to each other so as not to produce a parasite field and in the example described, each pair of conducting wires in question forms a cable 126** with coaxial structure. Thus, any disturbing magnetic field (which might have been included by a "loop" including the magnet and its connecting wires if they had been respectively connected to the axial end of the magnet) is eliminated from the vicinity of the magnet. The fact of using the tie rods (or tubular casing) for bringing the current back towards an axial end of the magnet has the additional advantage of compensating for the axial component of the current which flows in the Bitter coil, due to the helical pitch of the winding. This component is small and creates no field along the axis ZZ'. It modifies little the modulus of the field and only its orientation. Compensation for this longitudinal current component by the currents which flow in the tie rods brings then the orientation of the magnetic field back along the axis ZZ'.

Furthermore, the connecting structure illustrated in FIG. 3 may be used for passing the current between the coils if the magnet has more than one. In this case, all the end plates of the coils (except the one situated at the other axial end of the magnet) are similar to plate **118*a*** and two neighboring coils are connected by as many coaxial cables as there are tie rods.

The invention is not limited to the embodiment which has just been described. Furthermore, it should be noted that if certain structural elements (a tubular casing, rods or tie rods) have been defined as providing the current "return" it was simply for better showing the new function of the structural elements but it is obvious that the above described arrangement is protected in the following claims independently of the conventional direction of the current which flows in the coil or coils and said structural elements. The invention also covers all the technical equivalents of the means used if they come within the scope of the following claims.

What is claimed is:

1. A solenoidal magnet having at least one Bitter type coil, including essentially a substantially helical winding formed by a stack, with interpositioning of insulators, of conducting disks each having a cut so as to form a turn, said turns being connected to each other, which magnet further includes at least one conductor ensuring the return of the current to one of the axial ends of the magnet, arranged so as to distribute the flow of said current longitudinally over a cylindrical surface coaxial with said coil.

2. The solenoidal magnet as claimed in claim 1, including several longitudinal rods evenly spaced apart over said cylindrical surface and said rods are connected together so as to define a sort of squirrel cage, this cage being connected in series, as a whole, with said coil so that said rods have flowing therethrough substantially equal fractions of the total current which passes through said coil.

3. The magnet as claimed in claim 2 of a type in which said stack of disks is held in position by means of insulated tie rods, wherein said longitudinal rods are formed by at least some of said tie rods.

4. The magnet as claimed in claim 2 or 3, of the type in which said stack is clamped between two conducting end plates, wherein the longitudinal rods in the vicinity of the end plates situated at the other axial end of said magnet are connected electrically to this plate so as to distribute the current between said longitudinal rods.

5. The magnet as claimed in claim 4, wherein said longitudinal rods pass through the end plate situated at the first axial end mentioned of the magnet while being electrically insulated therefrom and this end plate has as many connecting terminals as there are such rods situated respectively in the vicinity of each of them so as to allow said magnet to be supplied with electricity from an equal number of pairs of parallel conducting wires.

6. The magnet as claimed in claim 5, wherein each pair of conducting wires is a cable with a coaxial structure.

7. The coil magnet as claimed in one of claims 1–4, wherein each turn end has a tongue and groove joint and two adjacent turns are connected end to end by welding such tongue and grooves of complementary shapes.

8. The coil magnet as claimed in one of claims 1–3, wherein said conducting disks are made from aluminum and said insulator is formed by anodization of these rings.

* * * * *